US011582545B2

(12) United States Patent
Kurihara et al.

(10) Patent No.: US 11,582,545 B2
(45) Date of Patent: Feb. 14, 2023

(54) ACOUSTIC OUTPUT DEVICE

(71) Applicant: SONY CORPORATION, Tokyo (JP)

(72) Inventors: Daisuke Kurihara, Tokyo (JP); Ryo Tsuchiya, Tokyo (JP)

(73) Assignee: SONY CORPORATION, Tokyo (JP)

( * ) Notice: Subject to any disclaimer, the term of this patent is extended or adjusted under 35 U.S.C. 154(b) by 14 days.

(21) Appl. No.: 17/250,405

(22) PCT Filed: Jun. 7, 2019

(86) PCT No.: PCT/JP2019/022758

§ 371 (c)(1),
(2) Date: Jan. 18, 2021

(87) PCT Pub. No.: WO2020/021877

PCT Pub. Date: Jan. 30, 2020

(65) Prior Publication Data

US 2021/0321188 A1 Oct. 14, 2021

(30) Foreign Application Priority Data

Jul. 27, 2018 (JP) ..... JP2018-141102

(51) Int. Cl.
*H04R 1/10* (2006.01)
*H01H 13/14* (2006.01)
*H01H 13/50* (2006.01)

(52) U.S. Cl.
CPC ..... *H04R 1/1041* (2013.01); *H01H 13/14* (2013.01); *H01H 13/50* (2013.01); *H04R 1/1016* (2013.01); *H04R 1/1058* (2013.01)

(58) Field of Classification Search
CPC ..... H04R 1/1041; H04R 1/10
See application file for complete search history.

(56) References Cited

U.S. PATENT DOCUMENTS 11,356,763 B2 * 6/2022 Zhang ..... H04R 1/105
2010/0166208 A1 7/2010 Kato
(Continued)

FOREIGN PATENT DOCUMENTS

CN 101771909 A 7/2010
JP 2010-157896 A 7/2010
JP 2013-114767 A 6/2013

OTHER PUBLICATIONS

International Search Report and Written Opinion of PCT Application No. PCT/JP2019/022758, dated Sep. 3, 2019, 08 pages of ISRWO.

*Primary Examiner* — Olisa Anwah
(74) *Attorney, Agent, or Firm* — Chip Law Group

(57) ABSTRACT

An acoustic output device includes a base case whose internal space is formed as an arrangement space and in which an insertion hole communicating with the internal space is formed, a cover that covers at least a part of the base case, an elastically deformable waterproof sheet including a flat surface portion joined to the base case and a bag-shaped pocket portion inserted into the insertion hole, a push button including an operating portion to be pressed and operated and a working portion inserted into the pocket portion, a substrate that is arranged in the arrangement space, and a switch that is arranged on the substrate and operated by the working portion via the pocket portion.

8 Claims, 5 Drawing Sheets

(56) References Cited

U.S. PATENT DOCUMENTS

| | | | | |
|---|---|---|---|---|
| 2015/0110320 | A1* | 4/2015 | Liu | H04R 1/44<br>381/322 |
| 2018/0063620 | A1* | 3/2018 | Kim | H04R 1/1025 |
| 2018/0184191 | A1* | 6/2018 | Kim | H04R 1/1041 |
| 2020/0252715 | A1* | 8/2020 | Zhou | H04R 1/1041 |

* cited by examiner

ACOUSTIC OUTPUT DEVICE

CROSS REFERENCE TO RELATED APPLICATIONS

This application is a U.S. National Phase of International Patent Application No. PCT/JP2019/022758 filed on Jun. 7, 2019, which claims priority benefit of Japanese Patent Application No. JP 2018-141102 filed in the Japan Patent Office on Jul. 27, 2018. Each of the above-referenced applications is hereby incorporated herein by reference in its entirety.

TECHNICAL FIELD

The present technology relates to a technical field of an acoustic output device provided with a push button for operating a switch.

BACKGROUND ART

Among acoustic output devices that are used as headphones or earphones and output sound from speakers, there is an acoustic output device provided with a switch arranged on a substrate and a push button for operating the switch (see, for example, Patent Document 1).

In the above-described acoustic output device, the switch is arranged in an internal space of a housing, and at least a part of the push button is positioned to be exposed to the outside of the housing. The push button is configured to be moved to a switch side by a pressing operation of a user and operate the switch.

Incidentally, among the acoustic output devices provided with the push buttons as described above, there is an acoustic output device having a waterproof structure for waterproofing the internal space of the housing. For example, a flat waterproof sheet that can be elastically deformed is arranged between the push button and the switch to waterproof the internal space while the switch is operated via the waterproof sheet that is elastically deformed by the push button.

In the waterproof structure described above, generally, a seat mounting portion including a seat insertion hole is arranged inside the housing, and the switch and the push button are positioned on opposite sides with the seat insertion hole interposed therebetween. The waterproof sheet includes a deformed portion facing the push button and an annular joint portion surrounding the deformed portion, and the joint portion is joined to a portion around the insertion hole in the seat mounting portion. When the push button is pressed and operated, the deformed portion of the waterproof sheet is pressed, elastically deformed, and pushed into the sheet insertion hole, and the switch is operated by the push button via the deformed portion.

CITATION LIST

Patent Document

Patent Document 1: Japanese Patent Application Laid-Open No. 2010-157896

SUMMARY OF THE INVENTION

Problems to be Solved by the Invention

However, in the above-described structure, since the seat mounting portion and the joint portion of the waterproof sheet are positioned to protrude from the switch and the push button in a direction orthogonal to an operation direction of the push button (a direction in which the switch and the push button are juxtaposed), there is a concern that downsizing of the acoustic output device in the direction orthogonal to the operation direction of the push button may be hindered.

Therefore, an object of the present technology is to reduce the size in the direction orthogonal to the operation direction of the push button.

Solutions to Problems

An acoustic output device according to the present technology includes a base case whose internal space is formed as an arrangement space and in which an insertion hole communicating with the arrangement space is formed, a cover that covers at least a part of the base case, an elastically deformable waterproof sheet including a flat surface portion joined to the base case and a bag-shaped pocket portion inserted into the insertion hole, a push button including an operating portion to be pressed and operated and a working portion inserted into the pocket portion, a substrate that is arranged in the arrangement space, and a switch that is arranged on the substrate and operated by the working portion via the pocket portion.

As a result, in the waterproof sheet, the pocket portion is positioned between the push button and the switch with the flat surface portion joined to the base case.

In the above-described acoustic output device according to the present technology, it is desirable that the flat surface portion is inclined with respect to an operation direction of the push button.

As a result, the flat surface portion of the waterproof sheet is arranged to face in a direction different from the operation direction of the push button and a direction orthogonal to the operation direction of the push button.

In the above-described acoustic output device according to the present technology, it is desirable that the flat surface portion is parallel to an operation direction of the push button.

As a result, the flat surface portion of the waterproof sheet is arranged to face in the direction orthogonal to the operation direction of the push button.

In the above-described acoustic output device according to the present technology, it is desirable that the push button includes an intermediate portion positioned between the working portion and the operating portion, the working portion protrudes from the intermediate portion in a direction bent from the intermediate portion, a space inside the working portion and the intermediate portion is formed as a component space, and a part of each of the flat surface portion and the base case is arranged in the component space.

As a result, the component space formed by the working portion and the intermediate portion is utilized as a space for arranging a part of each of the flat surface portion and the base case.

In the above-described acoustic output device according to the present technology, it is desirable that an opening edge of the pocket portion on a side of the operating portion is positioned further away from the intermediate portion than an opening edge of the pocket portion on an opposite side of the operating portion, in a protruding direction of the working portion.

As a result, it is possible to reduce the amount of protrusion of the working portion inserted into the pocket portion in the protruding direction.

In the above-described acoustic output device according to the present technology, it is desirable that the operating portion protrudes from the intermediate portion in a same direction as a protruding direction of the working portion.

As a result, a position where the working portion presses the switch and a position where the operating portion is pressed and operated are close to each other in the direction orthogonal to the operation direction of the push button.

In the above-described acoustic output device according to the present technology, it is desirable that the operating portion is continuously provided on an end surface of the intermediate portion on an opposite side of the working portion.

As a result, a structure of the push button is simplified.

In the above-described acoustic output device according to the present technology, it is desirable that the base case is provided with an insertion portion that is inserted into an ear canal and on which a sound output hole is formed, and an insertion direction of the insertion portion into the ear canal and an operation direction of the push button are different.

As a result, the insertion direction of the insertion portion and the operation direction of the push button are not the same.

In the above-described acoustic output device according to the present technology, it is desirable that the base case is provided with an insertion portion that is inserted into an ear canal and on which a sound output hole is formed, and an insertion direction of the insertion portion into the ear canal and a direction in which the substrate faces are same.

As a result, a surface direction of the substrate and the insertion direction of the insertion portion are set to different directions.

Effects of the Invention

According to the present technology, since the pocket portion of the waterproof sheet is positioned between the push button and the switch with the flat surface portion joined to the base case, it is not necessary to arrange the flat surface portion in a state where the flat surface portion faces in the same direction as the operation direction of the push button. Thus, it is possible to reduce the size in the direction orthogonal to the operation direction of the push button.

Note that the effect described here is not necessarily limited, and may be any effects described in the present disclosure.

MODE FOR CARRYING OUT THE INVENTION

Figure 1:
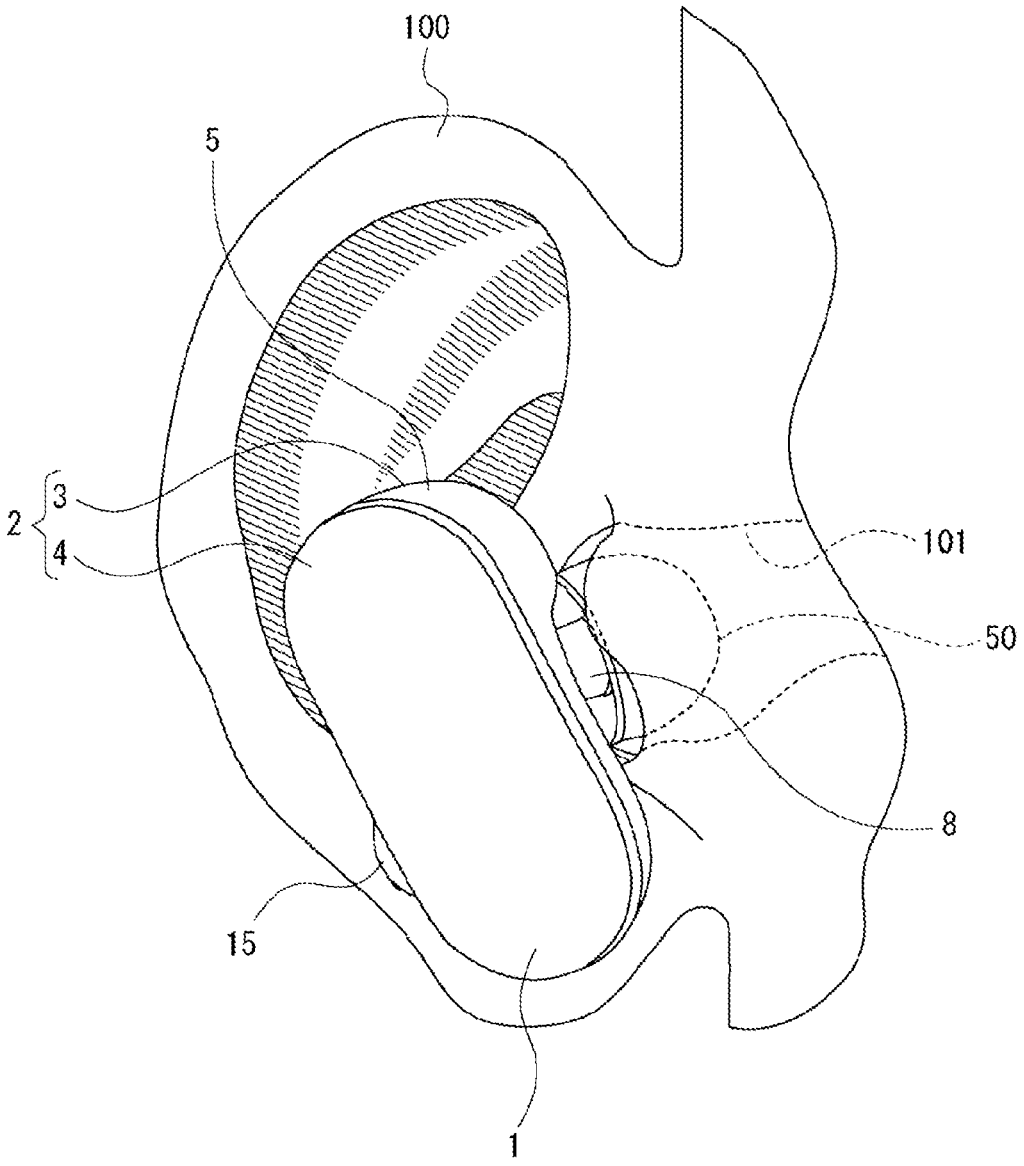
FIG. 1 illustrates an embodiment of an acoustic output device of the present technology together with FIGS. 2 to 9, and is a diagram illustrating a state where the acoustic output device is attached to an ear.

Hereinafter, an embodiment of an acoustic output device of the present technology will be described with reference to the accompanying drawings.

The embodiment shown below is an application of the acoustic output device of the present technology to an earphone. However, the scope of application of the present technology is not limited to the earphone, and the present technology can be widely applied to various other acoustic output devices such as a headphone.

<Configuration of Acoustic Output Device>

First, a configuration of the acoustic output device will be described (see FIGS. 1 to 4). One of acoustic output devices 1 and 1 is used for a right ear 100 and the other is used for a left ear 100. However, one acoustic output device 1 may be used to listen to a sound.

The acoustic output device 1 is used by an ear pad and an insertion portion on which the ear pad is mounted being inserted into the ear canal. In the following description, front-rear, vertical, left-right directions are indicated, assuming that a direction in which the insertion portion is inserted into the ear 100 or taken out from the ear 100 is defined as the left-right direction. Note that, the front-rear, vertical, left-right directions indicated below are for convenience of description, and implementation of the present technology is not limited to these directions.

The acoustic output device 1 is formed by each required part being arranged in or supported by a housing 2. The housing 2 includes a base case 3 and a cover 4 covering a part of the base case 3 from one side in the left-right direction (see FIGS. 1 to 3). In the housing 2, a gap 2*a* is formed between the base case 3 and the cover 4, and a button insertion hole 2*b* that communicates with the gap 2*a* is formed at a rear end of the housing 2 (see FIG. 4).

The base case 3 includes at least a container-shaped body portion 5 opened on a side of the cover 4 and an inner lid portion 6 covering an opening of the body portion 5, and an internal space formed by the body portion 5 and the inner lid portion 6 is formed as an arrangement space 3*a*. An outer peripheral portion of the inner lid portion 6 is joined to an opening edge of the body portion 5 by, for example, laser welding. In the arrangement space 3*a*, a substrate and a switch, which will be described later, are arranged, and internal structures such as a speaker, a battery, and a communication device for performing various communications, which are not illustrated, are arranged, for example. Note that the body portion 5 and the inner lid portion 6 may be integrally formed.

Figure 2:
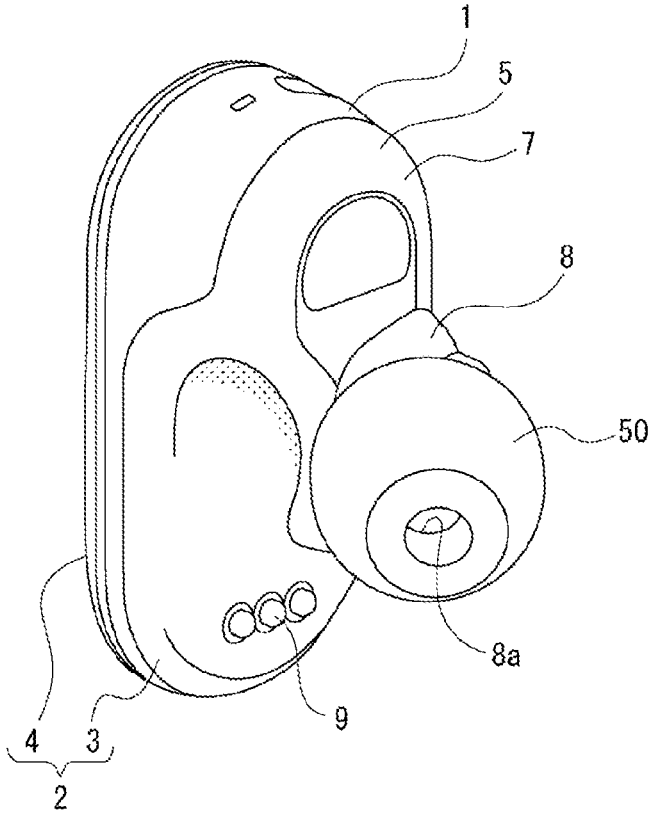
FIG. 2 is a perspective view of the acoustic output device.
Figure 3:
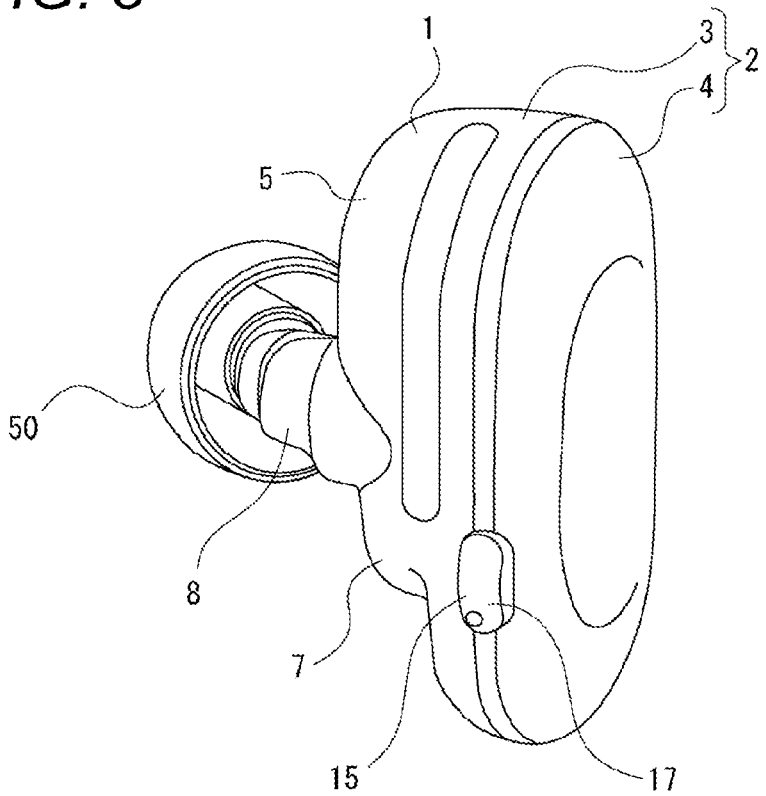
FIG. 3 is a perspective view of the acoustic output device from another direction.

The body portion 5 includes a base portion 7 to which the inner lid portion 6 is joined, and an insertion portion 8 protruding from the base portion 7 to an opposite side of the inner lid portion 6 (see FIGS. 1 to 3).

The base portion 7 is formed in a flat shape in which a vertical width is larger than a front-rear width and a left-right width is smaller than the vertical width and the front-rear width. In the base portion 7, a width of a lower end portion in the left-right direction is smaller than a width of an upper end portion in the left-right direction. A plurality of, for example, three terminal portions 9 are provided on an outer surface of the lower end portion of the base portion 7, and a battery not illustrated is charged via the terminal portions 9, for example.

The insertion portion 8 protrudes substantially to the left or substantially to the right from an intermediate portion in the vertical direction of the base portion 7. An ear pad 50 is detachably mounted on a tip of the insertion portion 8. When the acoustic output device 1 is attached to the ear 100, the insertion portion 8 and the ear pad 50 are inserted into an ear canal 101 of the ear 100 (see FIG. 1). A sound output hole 8*a* is formed at the tip of the insertion portion 8.

Figure 4:
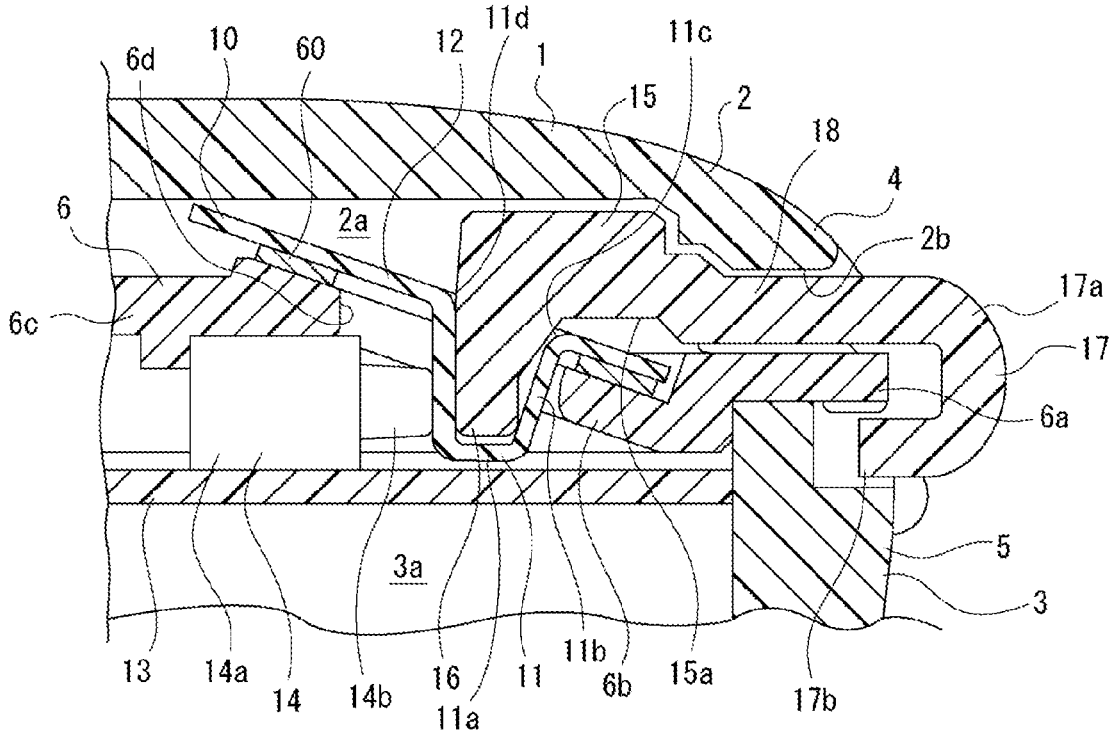
FIG. 4 is a cross-sectional view illustrating a state where a push button is not pressed and operated.

The inner lid portion 6 includes a first flat plate portion 6*a*, part of which is arranged in the button insertion hole 2*b*, an inclined portion 6*b* that is continuous with the first flat plate portion 6*a*, and a second flat plate portion 6*c* that is continuous with the inclined portion 6*b* and is positioned on an opposite side of the first flat plate portion 6*a* with the inclined portion 6*b* interposed therebetween (see FIG. 4). The inclined portion 6*b* is inclined away from the cover 4 toward a side of the first flat plate portion 6*a*. In the inclined portion 6*b*, an insertion hole 6*d* communicating with the gap 2*a* and the arrangement space 3*a* is formed.

An elastically deformable waterproof sheet 10 is joined to a surface of the inclined portion 6*b* on a side of the cover 4. The waterproof sheet 10 includes a bag-shaped pocket portion 11 inserted into the insertion hole 6*d*, and an annular flat surface portion 12 surrounding the pocket portion 11.

The pocket portion 11 is opened on the side of the cover 4, and includes a bottom surface portion 11*a* facing the opening and an annular peripheral surface portion 11*b* that is continuous with the bottom surface portion 11*a*. The flat surface portion 12 is joined to the inclined portion 6*b* via, for example, an annular double-sided tape 60. As a result, the insertion hole 6*d* is closed by the waterproof sheet 10, and water is prevented from entering the arrangement space 3*a* from a side of the gap 2*a*. Therefore, the arrangement space 3*a* can be waterproofed. Furthermore, a waterproof structure not illustrated is provided inside the insertion portion 8, and this waterproof structure prevents water from entering the arrangement space 3*a* from the sound output hole 8*a*.

In the arrangement space 3*a*, a substrate 13 that performs various types of control of the acoustic output device 1 is arranged. The substrate 13 is positioned to be juxtaposed with the inner lid portion 6 in the left-right direction in a state of facing in the left-right direction. Since the direction in which the substrate 13 faces is substantially the same as an insertion direction of the insertion portion 8 into the ear canal 101, a surface direction of the substrate 13 and the insertion direction of the insertion portion 8 into the ear canal 101 are set to different directions. Therefore, the acoustic output device 1 can be downsized in the insertion direction of the insertion portion 8 into the ear canal 101.

On a surface of the substrate 13 on a side of the inner lid portion 6, a switch 14 is arranged. The switch 14 includes a main body portion 14*a* connected to the substrate 13 and an operated portion 14*b* protruding from the main body portion 14*a* in a direction along the substrate 13. The operated portion 14*b* is positioned so that a tip surface thereof faces the peripheral surface portion 11*b* of the pocket portion 11. When the operated portion 14*b* is operated, an on/off state of the switch 14 is changed.

In the gap 2*a*, a portion of a push button 15 that operates the switch 14 except for a part of the push button 15 is arranged. The push button 15 includes a working portion 16 inserted into the pocket portion 11, an operating portion 17 positioned outside the housing 2 and to be pressed and operated by a user, and an intermediate portion 18 positioned between the working portion 16 and the operating portion 17. A part of the intermediate portion 18 is positioned in the button insertion hole 2*b*.

The working portion 16 protrudes from the intermediate portion 18 in a bending direction orthogonal to the intermediate portion 18. A space inside the working portion 16 and the intermediate portion 18 is formed as a component space 15*a*. In the component space 15*a*, the first flat plate portion 6*a* of the inner lid portion 6, a part of the inclined portion 6*b* of the inner lid portion 6, and a part of the flat surface portion 12 of the waterproof sheet 10 are arranged. As a result, the component space 15*a* can be effectively utilized as a space for arranging a part of each of the waterproof sheet 10 and the base case 3, and the acoustic output device 1 can be downsized.

The working portion 16 is juxtaposed with the operated portion 14*b* of the switch 14 with a part of the peripheral surface portion 11*b* of the pocket portion 11 interposed therebetween.

The operating portion 17 includes a protruding portion 17*a* protruding from the intermediate portion 18 in the same direction as a protruding direction of the working portion 16, and an auxiliary protrusion 17*b* protruding from a tip of the protruding portion 17*a* toward a side of the base case 3. An outer surface of the protruding portion 17*a* is formed in a curved surface. Forming the outer surface of the protruding portion 17*a* in a curved surface makes it possible to ensure a good operability. The protruding portion 17*a* protects the inner lid portion 6 by covering a tip of the first flat plate portion 6*a* from the rear.

In a state where the working portion 16 is inserted into the pocket portion 11, an opening edge 11*c* of the pocket portion 11 on a side of the operating portion 17 is positioned further away from the intermediate portion 18 than an opening edge 11*d* of the pocket portion 11 on an opposite side of the operating portion 17, in the protruding direction of the working portion 16 from the intermediate portion 18.

<Operation of Push button and Switch>

An operation when the push button 15 is pressed and operated and the switch 14 is operated in the above-described acoustic output device 1 will be described (see FIGS. 4 and 5).

FIG. 4 illustrates a state where the push button 15 is not pressed and operated. At this time, the push button 15 is in a state where an end portion of the intermediate portion 18 on a side of the working portion 16 protrudes from the housing 2. At least a part of the auxiliary protrusion 17*b* of the operating portion 17 is positioned to protrude from the housing 2. A space is formed between a tip surface of the auxiliary protrusion 17*b* and a wall surface (outer surface) forming the base case 3.

In the state where the push button 15 is not pressed and operated, the working portion 16 is positioned at a rear moving end in a state of being in contact with the peripheral surface portion 11*b* of the pocket portion 11. The switch 14 is in a state where the operated portion 14*b* greatly protrudes from the main body portion 14*a* and is not energized (off state).

Figure 5:
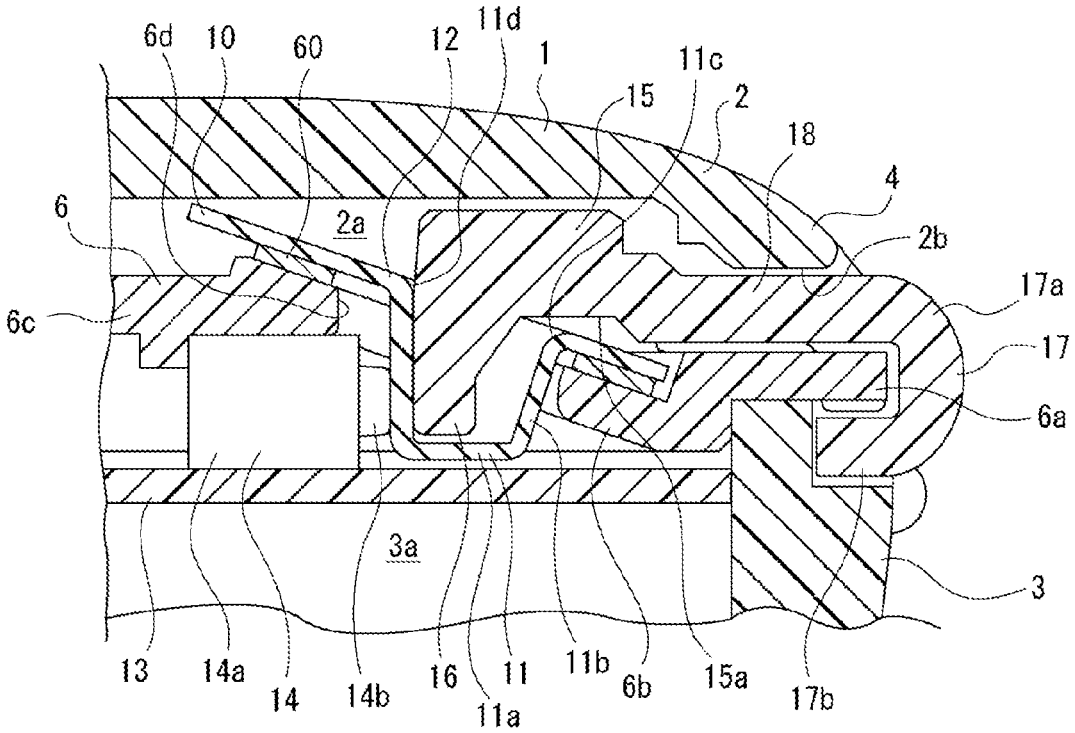
FIG. 5 is a cross-sectional view illustrating a state where the push button is pressed and operated.

FIG. 5 illustrates a state where the push button 15 is pressed and operated and the switch 14 is operated. When the operating portion 17 is pressed and operated, the push button 15 is moved to a side of the switch 14. The working portion 16 moved to the side of the switch 14 presses the operated portion 14*b* while elastically deforming the peripheral surface portion 11*b* of the pocket portion 11 to operate the switch 14. At this time, the bottom surface portion 11*a* is elastically deformed together with the peripheral surface portion 11*b* of the pocket portion 11, and a width of the pocket portion 11 in the front-rear direction is widened. At least a part of the operated portion 14*b* of the switch 14 is pushed toward a side of the main body portion 14*a*, so that the switch 14 is energized (on state).

In the state where the push button 15 is pressed and operated, the intermediate portion 18 and the auxiliary protrusion 17*b* of the operating portion 17 are positioned inside the housing 2. Since the auxiliary protrusion 17*b* is provided, the push button 15 can be moved only to a position where the auxiliary protrusion 17*b* is abutted against the base case 3, and the working portion 16 is not excessively moved to the side of the switch 14. Therefore, it is possible to prevent damage or the like of the switch 14 due to an excessive pressing operation.

When the pressing operation of the push button 15 is released, the pocket portion 11 is elastically recovered to return to a state before the bottom surface portion 11*a* and the peripheral surface portion 11*b* are elastically deformed. Due to the elastic recovery of the pocket portion 11, the push button 15 is moved toward an opposite side of the switch 14 to an original position before being pressed and operated, and the working portion 16 is moved to the rear moving end in a state of being in contact with the peripheral surface portion 11*b* of the pocket portion 11.

SUMMARY

As described above, the acoustic output device 1 includes the elastically deformable waterproof sheet 10 including the flat surface portion 12 joined to the base case 3 and the bag-shaped pocket portion 11 inserted into the insertion hole 6*d*, the push button 15 including the operating portion 17 to be pressed and operated and the working portion 16 inserted into the pocket portion 11, the substrate 13 that is arranged in the arrangement space 3*a*, and the switch 14 that is arranged on the substrate 13 and operated by the working portion 16 via the pocket portion 11.

As a result, in the waterproof sheet 10, the pocket portion 11 is positioned between the push button 15 and the switch 14 with the flat surface portion 12 joined to the base case 3. Therefore, it is not necessary to arrange the flat surface portion 12 face in the same direction as an operation direction of the push button 15, and it is possible to reduce the size in a direction orthogonal to the operation direction of the push button 15.

Furthermore, in the above-described acoustic output device 1, the flat surface portion 12 is inclined with respect to the operation direction of the push button 15. As a result, the flat surface portion 12 of the waterproof sheet 10 is arranged to face in a direction different from the operation direction of the push button 15 and the direction orthogonal to the operation direction of the push button 15. Therefore, it is possible to reduce the size in the operation direction of the push button 15 and the direction orthogonal to the operation direction of the push button 15.

Furthermore, in the above-described acoustic output device 1, the opening edge 11*c* of the pocket portion 11 on the side of the operating portion 17 is positioned further away from the intermediate portion 18 than the opening edge 11*d* of the pocket portion 11 on the opposite side of the operating portion 17, in the protruding direction of the working portion 16. As a result, it is possible to reduce the amount of protrusion of the working portion 16 inserted into the pocket portion 11 in the protruding direction, and the force applied to the push button 15 in a direction of deformation during the pressing operation of the operating portion 17 is reduced. Therefore, it is possible to increase the strength of the push button 15 and operate the push button 15 with a small force.

Furthermore, in the above-described acoustic output device 1, the base case 3 is provided with the insertion portion 8 that is inserted into the ear canal 101 of the user and on which the sound output hole 8*a* is formed, and the insertion direction of the insertion portion 8 into the ear canal 101 and the operation direction of the push button 15 are different. As a result, the insertion direction of the insertion portion 8 and the operation direction of the push button 15 are not the same. Therefore, when the push button 15 is pressed and operated in a state where the acoustic output device 1 is attached to the ear 100 of the user, it is possible to reduce a load on the ear 100.

Furthermore, in the above-described acoustic output device 1, the operating portion 17 protrudes from the intermediate portion 18 in the same direction as the protruding direction of the working portion 16. As a result, a position where the working portion 16 presses the switch 14 and a position where the operating portion 17 is pressed and operated are close to each other in the direction orthogonal to the operation direction of the push button 15, so that the force applied to the push button 15 in the direction of deformation during the pressing operation of the push button 15 is reduced. Therefore, it is possible to increase the rigidity of the push button 15 and operate the push button 15 with a small force.

<Modified Example of Push Button>

A push button 15A according to a modified example of the push button 15 will be described below (see FIGS. 6 and 7).

Figure 6:
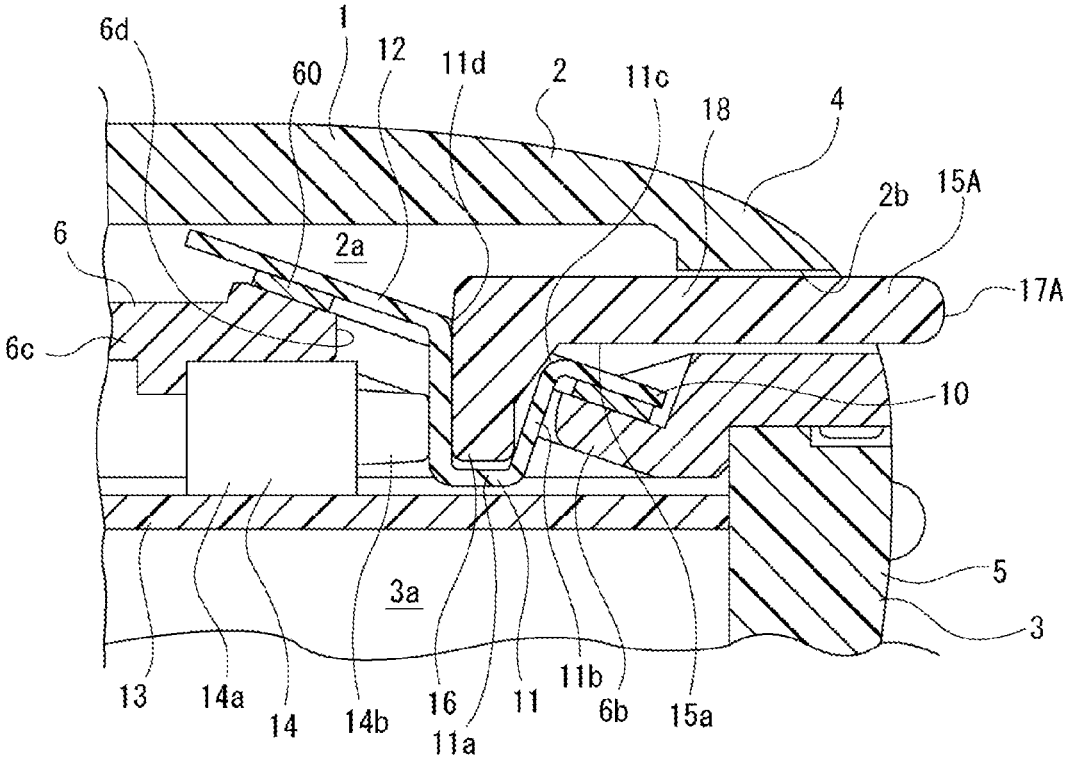
FIG. 6 illustrates a modified example of the push button together with FIG. 7, and is a cross-sectional view illustrating a state where the push button is not pressed and operated.
Figure 7:
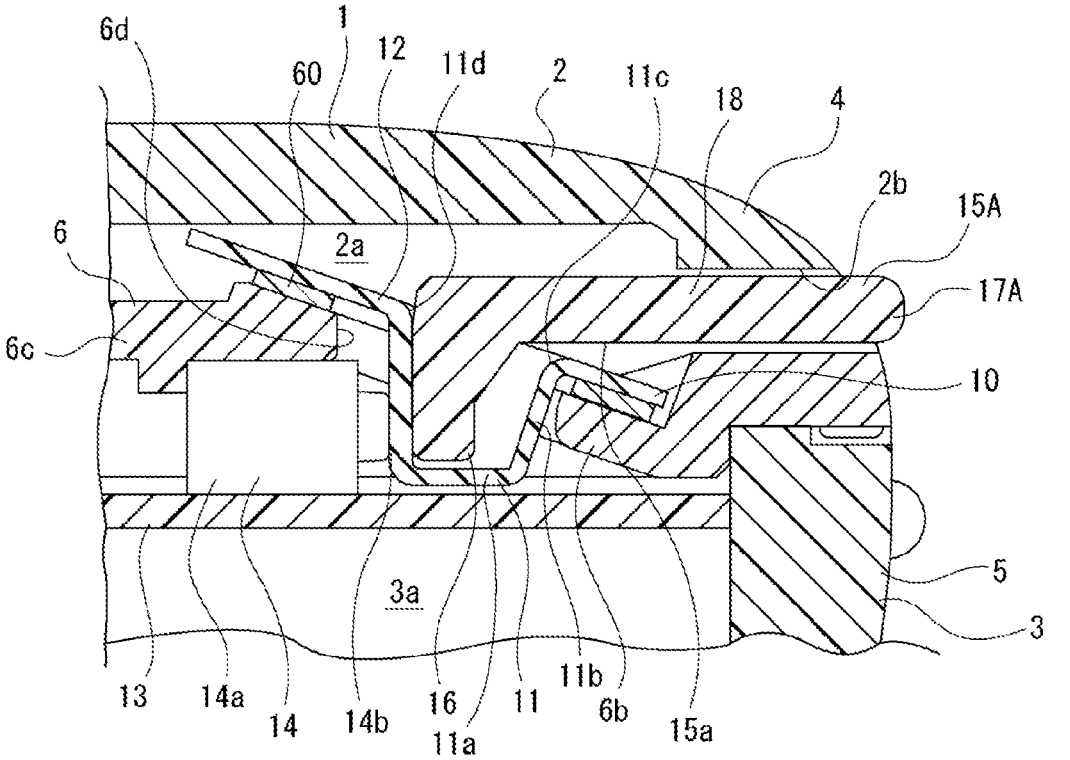
FIG. 7 is a cross-sectional view illustrating a state where the push button is pressed and operated.

In the push button 15A, an operating portion 17A is continuously provided on an end surface of the intermediate portion 18 on an opposite side of the working portion 16 (see FIG. 6). Therefore, the push button 15A is not provided with the protruding portion 17*a* and the auxiliary protrusion 17*b*. As a result, a structure of the push button 15A can be simplified, and a manufacturing cost of the acoustic output device 1 can be reduced. Furthermore, since the push button 15A does not include a portion positioned along an outer peripheral surface of the inner lid portion 6, a protruding part of the push button 15 from the housing 2 is smaller, so that the acoustic output device 1 can be downsized.

In a state where the push button 15A is not pressed, the working portion 16 is positioned at the rear moving end in a state of being in contact with the peripheral surface portion 11*b* of the pocket portion 11 (see FIG. 6). When the operating portion 17A is pressed and operated, the push button 15A is moved to the side of the switch 14. The working portion 16 moved to the side of the switch 14 presses the operated portion 14*b* while elastically deforming the peripheral surface portion lib of the pocket portion 11 to operate the switch 14 (see FIG. 7). When the pressing operation of the operating portion 17A is released, the pocket portion 11 is elastically recovered and the push button 15A is moved to the opposite side of the switch 14.

<Modified Example of Inner Lid Portion>

Next, an inner lid portion 6A according to a modified example of the inner lid portion 6 will be described (see FIGS. 8 and 9).

The inner lid portion 6A includes a third flat plate portion 6*e* arranged in the button insertion hole 2*b* and a fourth flat plate portion 6*f* that is continuous with the third flat plate portion 6*e*. In the inner lid portion 6A, a step 6*g* is formed between the third flat plate portion 6*e* and the fourth flat plate portion 6*f*. The third flat plate portion 6*e* and the fourth flat plate portion 6*f* are each arranged in parallel with the substrate 13. In the fourth flat plate portion 6*f*, an insertion hole 6*h* communicating with the gap 2*a* and the arrangement space 3*a* is formed.

The pocket portion 11 of the waterproof sheet 10 is inserted into the insertion hole 6*h*. The working portion 16 of the push button 15A is positioned in the pocket portion 11. The flat surface portion 12 is joined to the fourth flat surface portion 6*f* via the double-sided tape 60. Therefore, the flat surface portion 12 is not inclined with respect to an operation direction of the push button 15A, and the flat surface portion 12 is parallel to the operation direction of the push button 15A. Therefore, the flat surface portion 12 is arranged to face in a direction orthogonal to the operation direction of the push button 15A. The flat surface portion 12 is arranged to face in the direction orthogonal to the operation direction of the push button 15A, so that it is possible to reduce the size in the direction orthogonal to the operation direction of the push button 15A.

Figure 8:
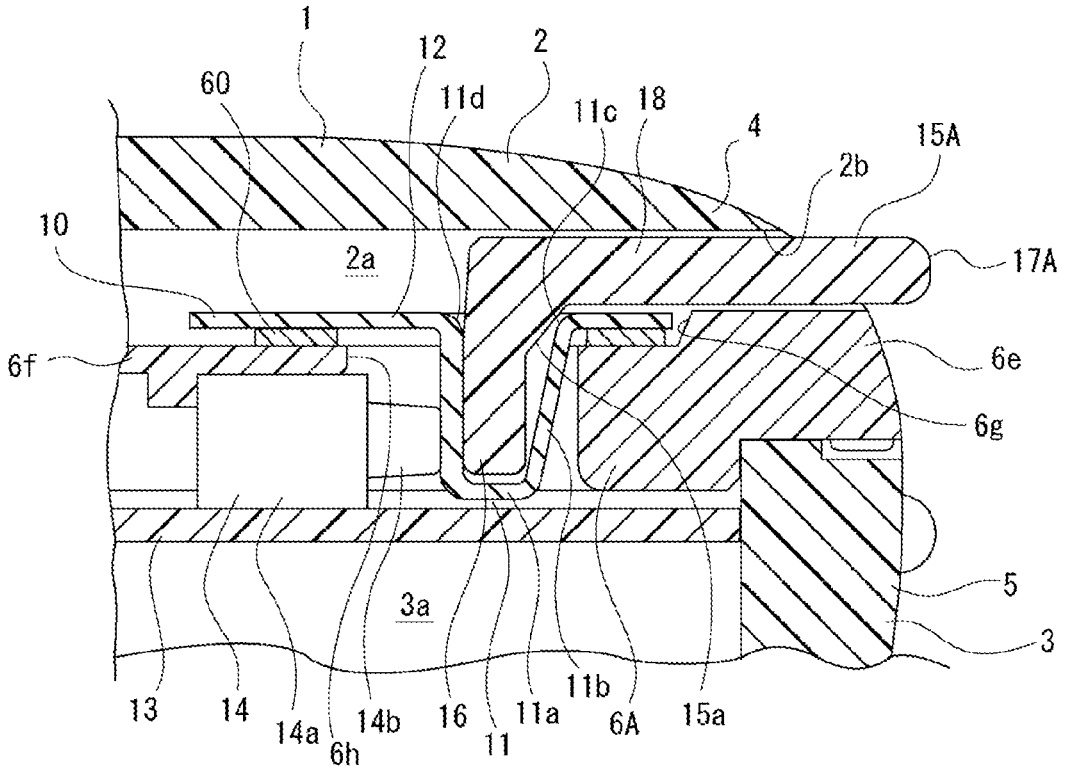
FIG. 8 illustrates a modified example of an inner lid portion together with FIG. 9, and is a cross-sectional view illustrating a state where the push button is not pressed and operated.
Figure 9:
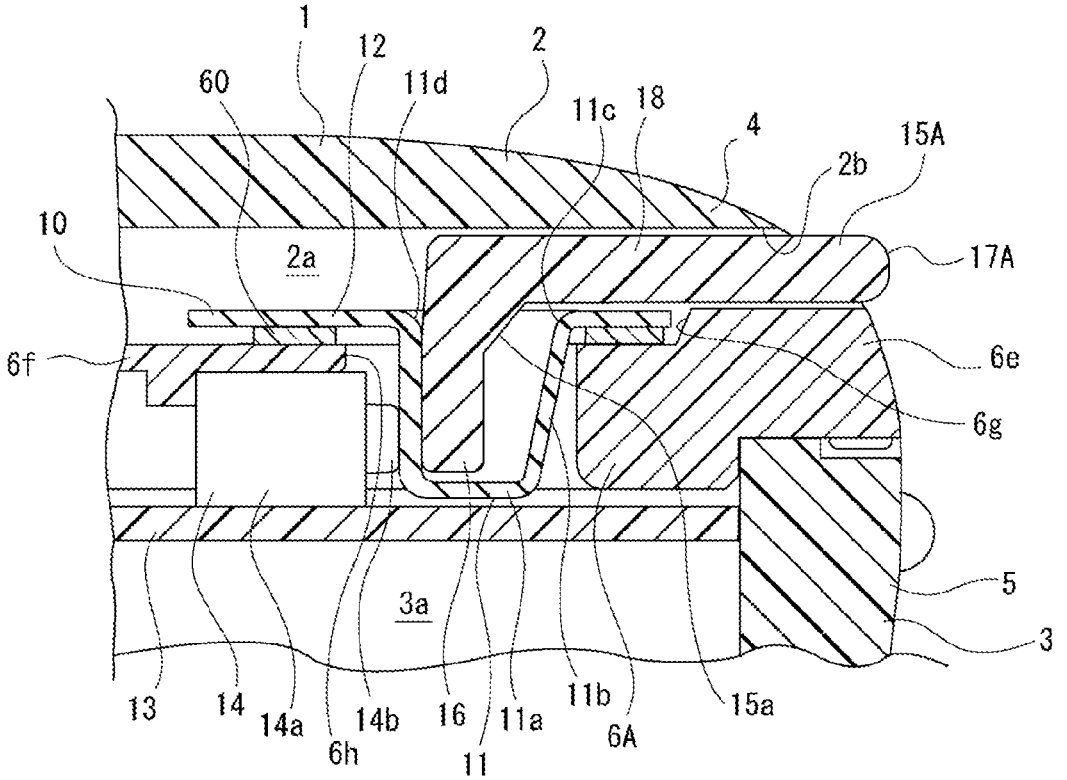
FIG. 9 is a cross-sectional view illustrating a state where the push button is pressed and operated.

In the state where the push button 15A is not pressed, the working portion 16 is positioned at the rear moving end in a state of being in contact with the peripheral surface portion 11*b* of the pocket portion 11 (see FIG. 8). When the operating portion 17A is pressed and operated, the push button 15A is moved to the side of the switch 14. The working portion 16 moved to the side of the switch 14 presses the operated portion 14*b* while elastically deforming the peripheral surface portion 11*b* of the pocket portion 11 to operate the switch 14 (see FIG. 9). When the pressing operation of the operating portion 17A is released, the pocket portion 11 is elastically recovered and the push button 15A is moved to the opposite side of the switch 14.

Note that it is also possible to use the push button 15 instead of the push button 15A in a configuration in which the inner lid portion 6A according to the modified example is used.

<Present Technology>

The present technology can be configured as follows.

(1)

An acoustic output device including a base case whose internal space is formed as an arrangement space and in which an insertion hole communicating with the arrangement space is formed, a cover that covers at least a part of the base case, an elastically deformable waterproof sheet including a flat surface portion joined to the base case and a bag-shaped pocket portion inserted into the insertion hole, a push button including an operating portion to be pressed and operated and a working portion inserted into the pocket portion, a substrate that is arranged in the arrangement space, and a switch that is arranged on the substrate and operated by the working portion via the pocket portion.

(2)

The acoustic output device according to (1), in which the flat surface portion is inclined with respect to an operation direction of the push button.

(3)

The acoustic output device according to (1), in which the flat surface portion is parallel to an operation direction of the push button.

(4)

The acoustic output device according to any of (1) to (3), in which the push button includes an intermediate portion positioned between the working portion and the operating portion, the working portion protrudes from the intermediate portion in a direction bent from the intermediate portion, a space inside the working portion and the intermediate portion is formed as a component space, and a part of each of the flat surface portion and the base case is arranged in the component space.

(5)

The acoustic output device according to (4), in which an opening edge of the pocket portion on a side of the operating portion is positioned further away from the intermediate portion than an opening edge of the pocket portion on an opposite side of the operating portion, in a protruding direction of the working portion.

(6)

The acoustic output device according to (4) or (5), in which the operating portion protrudes from the intermediate portion in a same direction as a protruding direction of the working portion.

(7)

The acoustic output device according to (4) or (5), in which the operating portion is continuously provided on an end surface of the intermediate portion on an opposite side of the working portion.

(8)

The acoustic output device according to any of (1) to (7), in which the base case is provided with an insertion portion that is inserted into an ear canal and on which a sound output hole is formed, and an insertion direction of the insertion portion into the ear canal and an operation direction of the push button are different.

(9)

The acoustic output device according to any of (1) to (7), in which the base case is provided with an insertion portion that is inserted into an ear canal and on which a sound output hole is formed, and an insertion direction of the insertion portion into the ear canal and a direction in which the substrate faces are same.

REFERENCE SIGNS LIST

1 Acoustic output device
2 Housing
3 Base case
3*a* Arrangement space
4 Cover
5 Body portion
6 Inner lid portion
6*b* Inclined portion
6*d* Insertion hole
7 Base portion
8 Insertion portion
8*a* Sound output hole
10 Waterproof sheet
11 Pocket portion
11*a* Bottom surface portion
11*b* Peripheral surface portion
12 Flat surface portion
14 Substrate
14 Switch
15 Push button
15*a* Component space
16 Working portion

17 Operating portion
18 Intermediate portion
50 Ear pad
60 Double-sided tape

The invention claimed is:

1. An acoustic output device, comprising:

a base case, wherein the base case includes an internal space as an arrangement space, and the base case includes an insertion hole which communicates with the arrangement space;

a cover that covers at least a part of the base case;

an elastically deformable waterproof sheet that includes a flat surface portion joined to the base case and a bag-shaped pocket portion inserted into the insertion hole;

a push button that includes:

an operating portion which is pressable and operable, a working portion inserted into the bag-shaped pocket portion, and an intermediate portion between the working portion and the operating portion, wherein the working portion protrudes from the intermediate portion in a direction bent from the intermediate portion, a space inside the working portion and the intermediate portion is a component space, and a part of the flat surface portion and the base case is in the component space;

a substrate in the arrangement space; and a switch on the substrate and operable by the working portion via the bag-shaped pocket portion.

2. The acoustic output device according to claim 1, wherein the flat surface portion is inclined with respect to an operation direction of the push button.

3. The acoustic output device according to claim 1, wherein the flat surface portion is parallel to an operation direction of the push button.

4. The acoustic output device according to claim 1, wherein an opening edge of the bag-shaped pocket portion on a side of the operating portion is further away from the intermediate portion than an opening edge of the bag-shaped pocket portion on an opposite side of the operating portion, in a protruding direction of the working portion.

5. The acoustic output device according to claim 1, wherein the operating portion protrudes from the intermediate portion in a same direction as a protruding direction of the working portion.

6. The acoustic output device according to claim 1, wherein the operating portion is continuously present on an end surface of the intermediate portion on an opposite side of the working portion.

7. The acoustic output device according to claim 1, wherein the base case includes an insertion portion that is inserted into an ear canal, a sound output hole is at a tip of the insertion portion, and an insertion direction of the insertion portion into the ear canal and an operation direction of the push button are different.

8. The acoustic output device according to claim 1, wherein the base case includes an insertion portion that is inserted into an ear canal, a sound output hole is at a tip of the insertion portion, and an insertion direction of the insertion portion into the ear canal and a direction in which the substrate faces are same.

* * * * *